US006202706B1

(12) United States Patent
Leban

(10) Patent No.: US 6,202,706 B1
(45) Date of Patent: Mar. 20, 2001

(54) TENSIONING MECHANISM FOR A CABLE TIE INSTALLATION TOOL

(75) Inventor: Joseph F. Leban, Warrenville, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 09/178,350

(22) Filed: Oct. 23, 1998

(51) Int. Cl.[7] ..... B21F 9/00
(52) U.S. Cl. ..... 140/123.5; 254/216
(58) Field of Search ..... 140/93 R, 93.2, 140/93.4, 123.5, 123.6; 254/213, 216

(56) References Cited

U.S. PATENT DOCUMENTS 2,638,314 * 5/1953 McFerren et al. ..... 140/93.2
3,327,619 * 6/1967 Sellman ..... 140/93.2
3,660,869 5/1972 Caveney et al. .
3,946,769 3/1976 Caveney et al. .
4,498,506 2/1985 Moody et al. .
5,205,328 4/1993 Johnson et al. .
5,595,220 1/1997 Leban et al. .

* cited by examiner

*Primary Examiner*—Lowell A. Larson
(74) *Attorney, Agent, or Firm*—Robert A. McCann

(57) ABSTRACT

A cable tie installation tool for advancing and fastening an individual cable tie, having a strap and a strap locking head, around a bundle of elongated objects, having a tensioning mechanism with a rotary driven member which develops a tension in the cable tie through a row of radially extending teeth disposed about the circumference of each laterally disposed edge of the member, and a recessed portion disposed about the circumference therebetween.

22 Claims, 4 Drawing Sheets

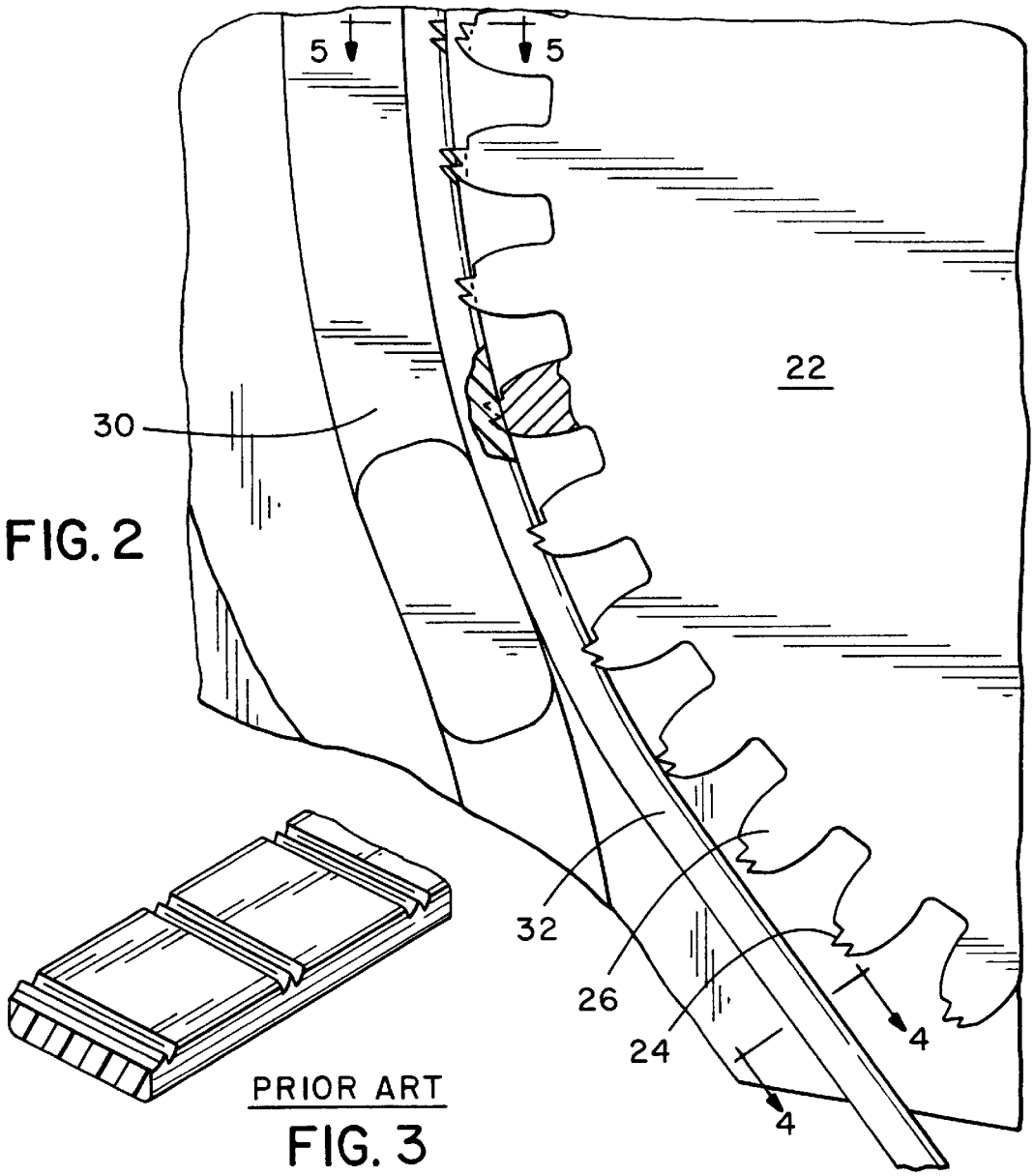
FIG. 2
PRIOR ART
FIG. 3
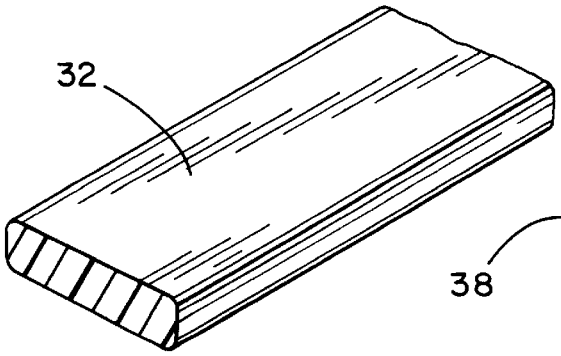
FIG. 4
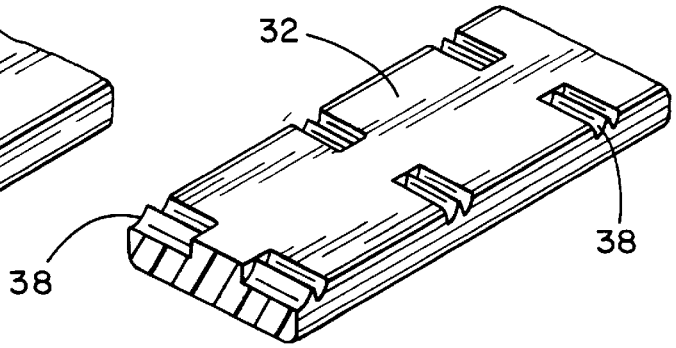
FIG. 5

TENSIONING MECHANISM FOR A CABLE TIE INSTALLATION TOOL

TECHNICAL FIELD

The present invention relates to a cable tie installation tool and more particularly to an improved tensioning mechanism which utilizes a gripper gear having a recessed portion.

BACKGROUND OF THE INVENTION

Many different tools for applying individual cable ties around a bundle of elongated objects are known in the art. Many incorporate a tensioning mechanism having some form of gripper gear, and others have some form of gripping device, which slightly penetrates the strap with teeth extending therefrom in order to achieve sufficient traction for tensioning the cable tie to the desired tension. The gear teeth of the prior art, FIG. 3, extend completely across the gripping face of the gear, normal to the direction of rotation. This orientation and configuration causes the tool to be unable to achieve the desired elevated tensions commonly used because the strap cross-section is so sizably decreased by tooth penetrations or deformations. The result when this full-width gear tooth is used to tension the cable tie results in a cable tie which is pulled apart at one of the gear teeth penetrations due to the substantially reduced cross-sectional area, since the strength of the cable tie strap is directly related to this area. Accordingly, it would be desirable to fabricate a tensioning mechanism having a gripper gear which can be reliably and consistently tension a cable tie strap to an elevated tension, as is commonly now required without the strap separation or shearing before reaching the desired tension level.

SUMMARY OF THE INVENTION

It is therefore, an object of the present invention to provide an improved cable tie installation tool.

It is a further object of the present invention to provide a cable tie installation tool which has the ability to reliably and consistently tension bundles of elongated objects to elevated levels.

It is a still further object of the present invention to provide a cable tie installation tool which has a tensioning assembly that increases the cross-sectional area of the cable tie strap during tensioning.

In general, the cable tie installation tool of the present invention can be used to advance and fasten an individual cable around a bundle of elongated objects. Normally, a cable tie includes a strap and a strap-locking head. Also included in the tool, among various other subassemblies, is a tensioning mechanism which has a rotary driven gripper gear member for developing a desired tension in the cable tie. Disposed about the circumferential edges of the cylindrical shaped gear member are a plurality of radially extending teeth. A recessed portion is located between the two parallel rows of teeth.

BRIEF DESCRIPTION OF THE DRAWINGS

FIG. 2 is an enlarged fragmentary side elevation of the gripper gear member of FIG. 1 shown with the cover removed;

FIG. 3 is a perspective view of a portion of prior art cable tie strap after engagement by the gripper gear member;

FIG. 4 is a sectional view of the cable tie strap of FIG. 1 taken along lines 4—4 of FIG. 2;

FIG. 5 is a sectional view of the cable tie strap of FIG. 1 taken along liens 5—5 of FIG. 2;

DESCRIPTION OF THE PREFERRED EMBODIMENT

A cable tie installation tool embodying the concept of the present invention is generally indicated by the numeral 10 in the accompanying drawings.

Tool 10 and nearly all of the working parts and subassemblies are of the general type similar to prior tools made by Applicant's common assignee, Panduit Corp., such as that described in U.S. Pat. No. 3,660,869 to Caveney et al., U.S. Pat. No. 3,946,769 to Caveney et al., U.S. Pat. No. 4,498,506 to Moody et al., U.S. Pat. No. 5,205,328 to Johnson et al, and U.S. Pat. No. 5,595,220 to Leban et al., each of which is incorporated herein by reference, and is designed to position, apply, tension and sever cable ties about a bundle of elongated objects 20.

Figure 1:
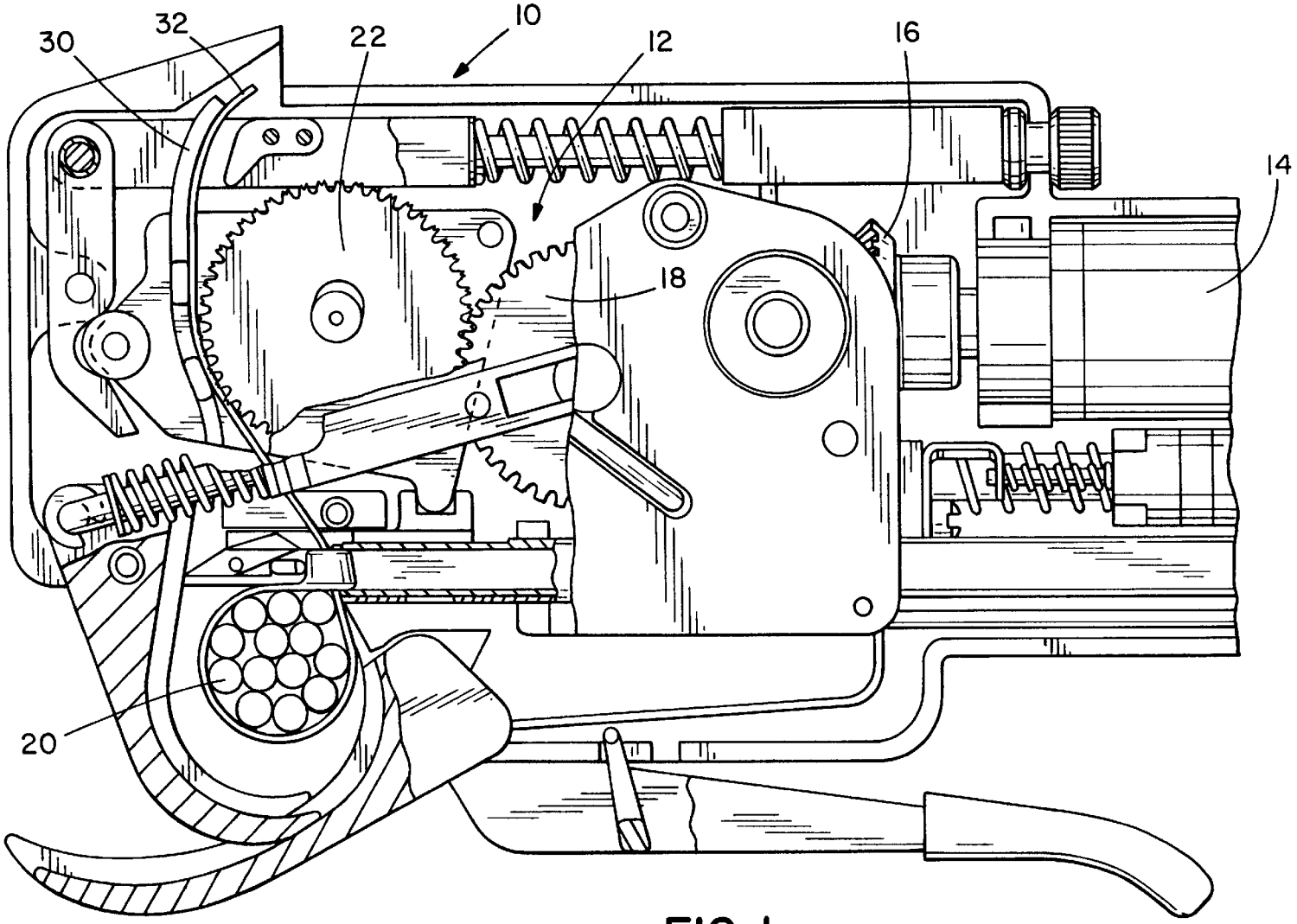
FIG. 1 is a fragmentary side elevation of a cable tie application tool embodying the concept of the present invention shown with the cover removed.

As seen in FIG. 1, tool 10 generally includes a tensioning mechanism 12 subassembly amongst the many others described in the above references. A motor 14 is suitably mounted in the tool member housing and drives a motor gear 16 positioned for engagement with a bevel gear (not shown). Transfer gear (not shown) is also secured to the bevel gear shaft and positioned for engagement with a cam gear 18 supported for rotational movement about the flatted cam gear shaft (not shown).

Figure 6:
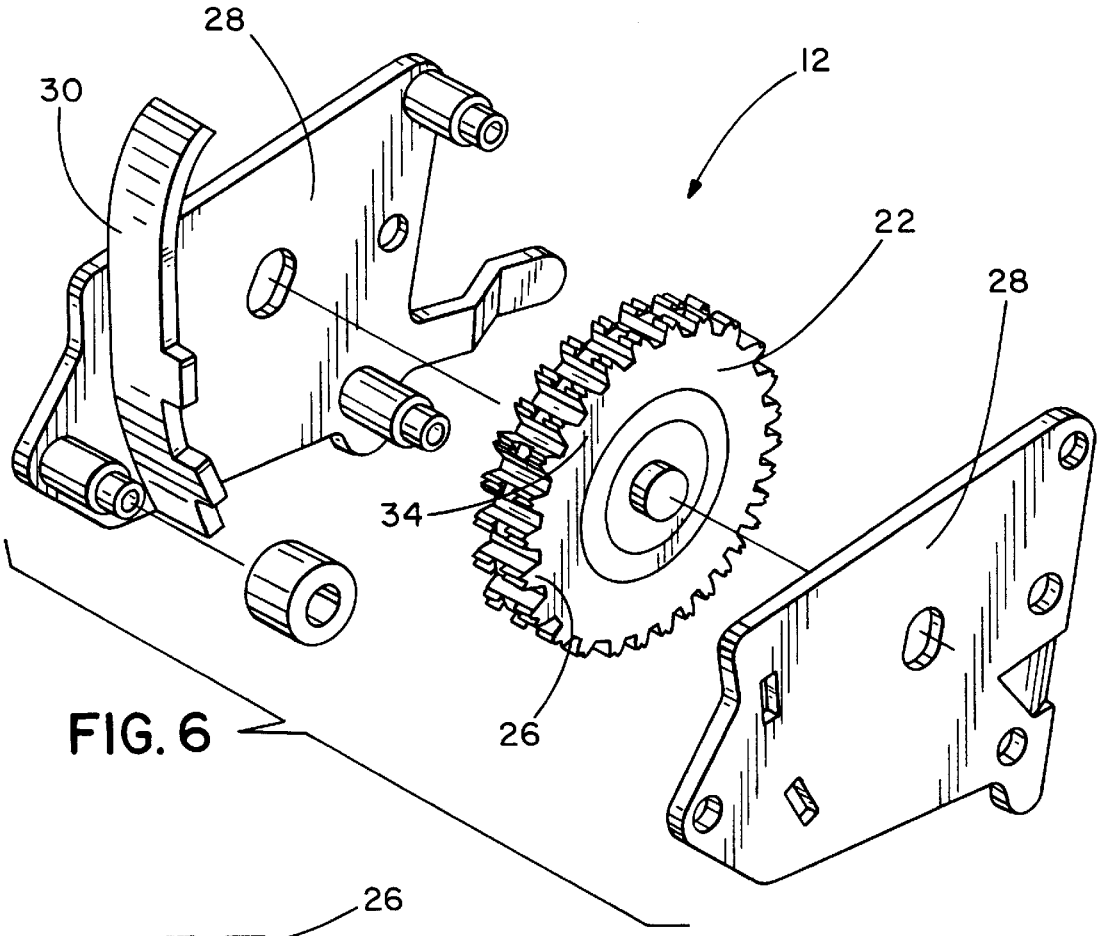
FIG. 6 is an exploded perspective view of the engagement portion of the tensioning mechanism of the tool of FIG. 1.

The tensioning mechanism further includes a rotary driven gripper gear member 22 having a pair of gripper teeth 24 on each of its gear teeth 26 and positioned for driving engagement with the cam gear 18. The gear member 22 is supported for relative movement between a pair of gripper plates 28, FIG. 6. The gripper plates 28 have a strap guide 30 positioned therebetween and spaced from the gear member 22 a distance sufficient to permit movement of the strap portion of a cable tie 32 therebetween.

Figure 7:
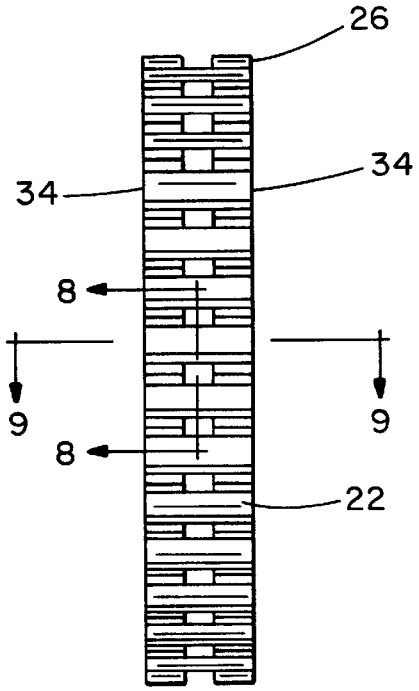
FIG. 7 is a front or radial view of the gripper gear member of FIG. 1.
Figure 8:
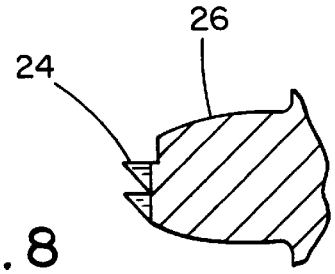
FIG. 8 is a side sectional view of the teeth of the gripper gear member of FIG. 1 taken along lines 8—8 of FIG. 7.
Figure 9:
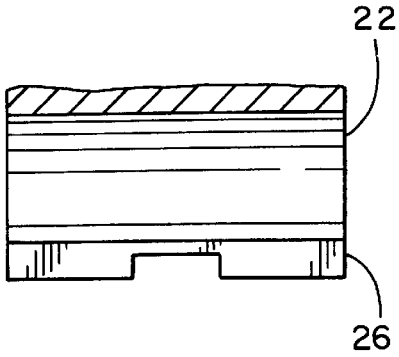
FIG. 9 is a top sectional view of the teeth of the gripper gear member of FIG. 1 taken along lines 9—9 of FIG. 7.

As seen in FIG. 7, the gear member 22 has two parallel rows of gear teeth 26. Each row is located at a lateral edge 34 of the gear member 22 and separated from each other by a recessed portion 36, see FIGS. 8 and 9, which does not engage the cable tie strap 32, during tensioning. The result is a cable tie strap 32 having penetration marks or patterns 38 which is best seen in FIG. 5. Prior art tools used gripper teeth which extended completely across the face of the gripper gear and resulted in a strap indentations best seen in FIG. 3, having the problems and undesirable traits explained above.

Figure 10:
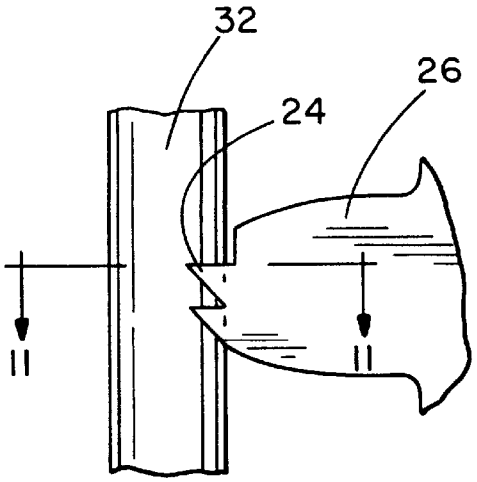
FIG. 10 is a side enlarged view of the teeth of the gripper gear member of FIG. 1 shown engaging the strap.
Figure 12:
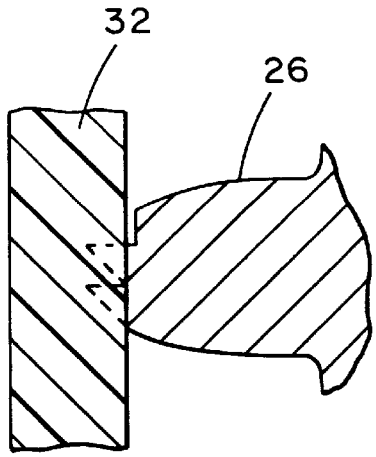
FIG. 12 is a side sectional view of the teeth of the gripper gear member of FIG. 1 taken along lines 12—12 of FIG. 11.
Figure 11:
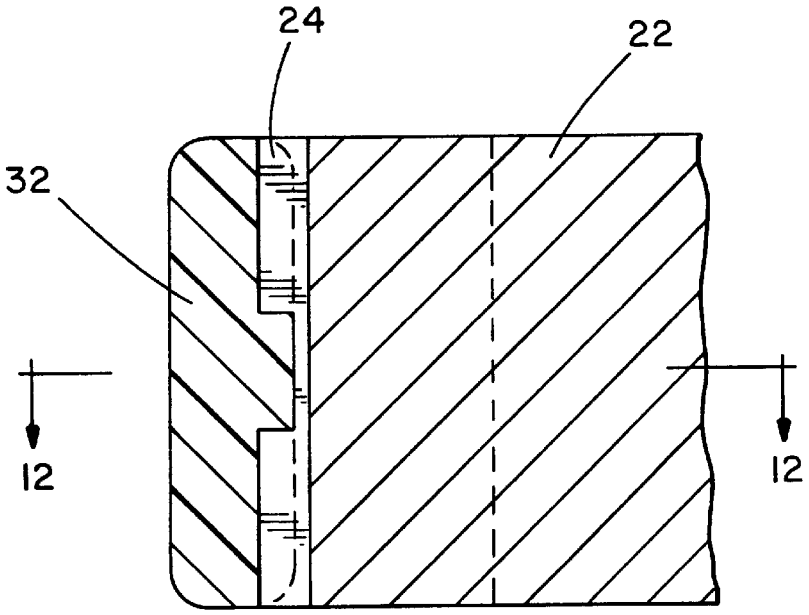
FIG. 11 is a top sectional view of the teeth of the gripper gear member of FIG. 1 taken along lives 11—11 of FIG. 10.

The tensioning of a cable tie strap is best seen in FIGS. 2, 4, 5 and 10–12. The cable tie strap 32 is advanced via a tool 10 subassembly, disclosed in one of the incorporated references, into the space between the gripper gear 22 and the strap guide 30. The pre-engagement configuration of the strap 32 is best characterized in FIG. 4. As tensioning begins, the gripper gear 22 starts to rotate and the two rows of gripper teeth 26 independently engage the cable tie strap 32 as best seen in FIGS. 10 and 12. The recessed portion 36 does not penetrate or engage the strap 32, as best seen in FIG. 11. As a result, the total cross-sectional area of the cable tie strap 32 is increased sufficiently such that increased tensioning loads may be applied. Prior art tools which engaged the strap as shown in FIG. 3, so decreased the cross-sectional area of the strap that the strength thereof was compromised during tensioning, such that failures occurred, i.e., straps not properly tensioned. As an additional benefit, the two independent parallel rows of gear teeth 26 help the tool 10 keep the strap 32 properly aligned during tensioning.

What is claimed is:

1. A cable tie installation tool for advancing and fastening an individual cable tie, having a strap and a strap locking head, around a bundle of elongated objects, comprising:

a tensioning mechanism having a rotary driven member, adapted to develop tension in an individual cable tie, said rotary driven member comprising:

a first lateral edge and a second lateral edge;

a first row of radially extending teeth circumferentially disposed adjacent said first lateral edge of said rotary driven member;

a second row of radially extending teeth circumferentially disposed adjacent said second lateral edge of said rotary driven member; and a recessed portion circumferentially disposed between said first and second rows of radially extending teeth; and said tensioning mechanism further comprises a driving element that engages said first row of teeth so as to cause said rotary driven member to rotate.

2. The cable tie installation tool of claim 1, wherein said recessed portion is not engaged by said driving element during rotation of said rotary driven member.

3. The cable tie installation tool of claim 2, wherein said driving element comprises a cam gear.

4. The cable tie installation tool of claim 1, wherein said driving element comprises a cam gear.

5. The cable tie installation tool of claim 1, wherein one of said teeth of said first row of teeth has a pair of gripping teeth attached thereto.

6. The cable tie installation tool of claim 1, wherein said recessed portion is smooth in texture.

7. A cable tie installation tool for advancing and fastening an individual cable tie, having a strap and a strap locking head, around a bundle of elongated objects, comprising:

a tensioning mechanism having a rotary driven member, adapted to develop tension in an individual cable tie, said rotary driven member comprising:

a first lateral edge and a second lateral edge;

a first radially extending tooth circumferentially disposed adjacent said first lateral edge of said rotary driven member;

a second radially extending tooth circumferentially disposed adjacent said second lateral edge of said rotary driven member;

a recessed portion circumferentially disposed between said first radially extending tooth and said second radially extending tooth; and said tensioning mechanism further comprises a driving element that engages said first tooth so as to cause said rotary driven member to rotate.

8. The cable tie installation tool of claim 7, wherein said recessed portion is not engaged by said driving element during rotation of said rotary driven member.

9. The cable tie installation tool of claim 8, wherein said driving element comprises a cam gear.

10. The cable tie installation tool of claim 7, wherein said driving element comprises a cam gear.

11. The cable tie installation tool of claim 7, wherein said recessed portion is smooth in texture.

12. A cable tie installation system comprising:

a cable tie installation tool comprising:

a tensioning mechanism having a rotary driven member, adapted to develop tension in an individual cable tie, said rotary driven member comprising:

a first lateral edge and a second lateral edge;

a first row of radially extending teeth circumferentially disposed adjacent said first lateral edge of said rotary driven member;

a second row of radially extending teeth circumferentially disposed adjacent said second lateral edge of said rotary driven member; and a recessed portion circumferentially disposed between said first and second rows of radially extending teeth; and said tensioning mechanism further comprises a driving element that engages said first row of teeth so as to cause said rotary driven member to rotate; and an individual cable tie comprising a strap locking head and a strap that is attached to said strap locking head and is engaged by said tensioning mechanism.

13. The cable tie installation system of claim 12, wherein said recessed portion is not engaged by said driving element during rotation of said rotary driven member.

14. The cable tie installation system of claim 13, wherein said driving element comprises a cam gear.

15. The cable tie installation system of claim 12, wherein said driving element comprises a cam gear.

16. The cable tie installation system of claim 12, wherein one of said teeth of said first row of teeth has a pair of gripping teeth attached thereto.

17. The cable tie installation system of claim 12, wherein said recessed portion is smooth in texture.

18. A cable tie installation system comprising:

a cable tie installation tool comprising:

a tensioning mechanism having a rotary driven member, adapted to develop tension in an individual cable tie, said rotary driven member comprising:

a first lateral edge and a second lateral edge;

a first radially extending tooth circumferentially disposed adjacent said first lateral edge of said rotary driven member;

a second radially extending tooth circumferentially disposed adjacent said second lateral edge of said rotary driven member; and a recessed portion circumferentially disposed between said first radially extending tooth and said second radially extending tooth; and said tensioning mechanism further comprises a driving element that engages said first tooth so as to cause said rotary driven member to rotate; and an individual cable tie comprising a strap locking head and a strap that is attached to said strap locking head and is engaged by said tensioning mechanism.

19. The cable tie installation system of claim 18, wherein said recessed portion is not engaged by said driving element during rotation of said rotary driven member.

20. The cable tie installation system of claim 19, wherein said driving element comprises a cam gear.

21. The cable tie installation system of claim 18, wherein said driving element comprises a cam gear.

22. The cable tie installation system of claim 18, wherein said recessed portion is smooth in texture.

* * * * *

UNITED STATES PATENT AND TRADEMARK OFFICE

CERTIFICATE OF CORRECTION

PATENT NO. : 6,202,706 B1
DATED : March 20, 2001
INVENTOR(S) : Joseph F. Leban

It is certified that error appears in the above-identified patent and that said Letters Patent is hereby corrected as shown below:

Column 1,
Line 65, "the" should be deleted and -- a prior art -- inserted.

Column 2,
Line 2, "liens" should be -- lines --.
Line 14, "lives" should be -- lines --.

Signed and Sealed this

Seventh Day of January, 2003

JAMES E. ROGAN
*Director of the United States Patent and Trademark Office*